US007145114B2

(12) United States Patent
Wakamatu et al.

(10) Patent No.: US 7,145,114 B2
(45) Date of Patent: Dec. 5, 2006

(54) SUPERHEATED VAPOR GENERATOR

(75) Inventors: Toshio Wakamatu, Osaka (JP); Tsutomu Kanou, Saitama (JP); Masanori Ogihara, Kanagawa (JP)

(73) Assignee: Pai Corporation, Tokyo (JP)

( * ) Notice: Subject to any disclaimer, the term of this patent is extended or adjusted under 35 U.S.C. 154(b) by 0 days.

(21) Appl. No.: 11/022,388

(22) Filed: Dec. 23, 2004

(65) Prior Publication Data

US 2005/0178761 A1 Aug. 18, 2005

(30) Foreign Application Priority Data

Feb. 13, 2004 (JP) ..... 2004-036331

(51) Int. Cl.
*H05B 6/08* (2006.01)

(52) U.S. Cl. ..... 219/629; 219/630; 219/661

(58) Field of Classification Search ..... 219/629, 219/628, 630, 667, 688, 682, 674, 672, 710, 219/718, 401, 601, 661
See application file for complete search history.

(56) References Cited

U.S. PATENT DOCUMENTS 2,407,562 A * 9/1946 Lofgren ..... 219/630
5,655,212 A * 8/1997 Sekhar et al. ..... 428/552
5,781,581 A * 7/1998 Fishman et al. ..... 373/152
5,990,465 A * 11/1999 Nakaoka et al. ..... 219/629

* cited by examiner

*Primary Examiner*—Quang Van
(74) *Attorney, Agent, or Firm*—Wood, Phillips, Katz, Clark & Mortimer

(57) ABSTRACT

A superheated vapor generator has a tubular, vertically extending container with closed ends. A high frequency induction heating coil is wound around the container. A heating medium is placed in the container and is made from material heatable by electromagnetic conduction. A number of vapor passages extend through the heating medium longitudinally of the tubular container. The tubular container has a heating section with the heating coil and a non-heating section under the heating section. Material for superheated vapor is supplied through a supply passage from a position above the heating medium to the non-heating section. A passage structure is provided in the non-heating section for flow of material supplied through the supply passage therethrough into the vapor passages of the heating medium. A discharge passage is formed above the heating medium. A discharge passage is formed above the heating medium for discharging superheated vapor.

20 Claims, 6 Drawing Sheets

SUPERHEATED VAPOR GENERATOR

FIELD OF THE INVENTION

The present invention relates to a superheated vapor generator for use in various fields. In particular, the invention relates to a superheated vapor generator that can generate superheated vapor in a wide temperature range, which may be 120° C.–700° C. The vapor generator can be used as, in or with thermal processing equipment for cooking, boiling, steaming, roasting, broiling, toasting, smoking, drying, sterilization, dezymotization, dissolution, fusion, melting, deposition, welding, cleaning, blowing, humidification, air conditioning, or the like.

BACKGROUND OF THE INVENTION

A conventional superheated vapor generator includes a drum made of metal or other magnetic material. Water or saturated steam is introduced into the drum, which is inductively heated. Another conventional superheated vapor generator includes a drum made of non-magnetic material, in which a magnetic material is buried. Still another conventional superheated vapor generator includes a heating element having holes formed through it. The heating element is coated with metal oxide to prevent oxidation. A further conventional superheated vapor generator includes a heating container filled with paraffin, in which a spiral pipe extends. The paraffin can be heated by an electric heater.

The superheated vapor generators in each of which a drum or a spiral pipe is heated have a heating/conducting area extending over only the inner surface or surfaces of the drum or spiral pipe. Accordingly, the heating/conducting area of these generators is narrow, so that their heating efficiency is low, and so that their heating time is long. In particular, the vapor generator in which paraffin can be heated to heat a spiral pipe cannot generate superheated vapor with a high temperature, which may be 500° C. These vapor generators are not suitable for multi-purpose heating because they cannot generate sufficiently dry vapor but are liable to generate wet steam. The superheated vapor generator including a heating element buried in a non-magnetic material as a coating material is less durable because the hot portion of the coating material deteriorates significantly by being damaged by thermal stress. Each of these vapor generators has an inlet port for water or saturated steam and an outlet port for superheated vapor. Because the inlet and outlet ports are positioned vertically away from each other, the replacement, repair or the like of the heating coil or element involves complex disassembly and assembly operations. The complex operations need to be performed by one or more skilled workers for a long time while the production line is suspended. This greatly influences the productivity.

A superheated vapor generator and a food processor may be installed in a food-processing place, where water is used frequently. It is necessary to separately position the vapor generator and food processor, and to supply superheated vapor from the generator through adiabatic piping to the processor. It is also necessary to take safety measures against electrical leaks and electric shocks. These necessary things raise the cost of equipment.

Patent Document 1: Japanese Unexamined Patent Publication No. H9-4803

Patent Document 2: Japanese Unexamined Patent Publication No. 2003-100427

Patent Document 3: Japanese Patent No. 2999228

SUMMARY OF THE INVENTION

In view of the foregoing problems, one object of the present invention is to provide a durable apparatus for efficiently generating highly dry superheated vapor. Another object is to make it possible to install the apparatus integrally with or adjacently to processing equipment. Still another object is to make the apparatus free from electrical leaks and electric shocks and simple in structure so that it can be repaired and maintained easily in a short time by even a less experienced engineer.

A superheated vapor generator according to the present invention includes a tubular container closed at both ends and extending substantially vertically. A high frequency induction heating coil is wound around the tubular container. A heating medium is placed in the tubular container. The heating medium is formed of material that can be heated by electromagnetic induction. The heating medium has a number of vapor passages extending through it substantially longitudinally of the tubular container. The tubular container has a heating section formed in it, where the heating coil heats the heating medium. The tubular container further has a non-heating section formed in it under the heating section. The vapor generator has a supply passage through which material for superheated vapor can be supplied from a position above the heating medium to the non-heating section. A passage structure is provided in the non-heating section so that the material supplied through the supply passage can flow through the structure into the vapor passages of the heating medium. The vapor generator also has a discharge passage formed above the heating medium so that superheated vapor can be discharged through this passage.

As stated above, the non-heating section is positioned under the heating section, which is heated by the high frequency induction heating coil. The non-heating section is heated indirectly by the heat conduction from the heating section. The passage structure in the non-heating section has a preset temperature. The material, which may be fluid such as liquid and/or vapor, supplied through the supply passage is distributed through the passage structure to the vapor passages of the heating medium. Consequently, while the material is flowing through the passage structure, it is rapidly heated and immediately forms saturated vapor. The saturated vapor expands suddenly in the passage structure and is forced into the vapor passages by its expansion pressure. The saturated vapor further keeps expanding in the vapor passages and flows through them at high speed while heated acceleratively. Through this process, the saturated vapor becomes fully dry superheated vapor. The superheated vapor flows out of the vapor passages and through the discharge passage to be supplied to thermal processing equipment or the like.

As stated above, the material changes into saturated vapor in the passage structure, and the saturated vapor is continuously heated acceleratively in the vapor passages of the heating medium, so that superheated vapor can be obtained instantaneously. Thus, the vapor passages function immediately downstream of the passage structure. This enables efficient generation of superheated vapor, resulting in the reduction of power consumption.

As stated above, the non-heating section is positioned under the heating section, which is heated by the high frequency induction heating coil. The non-heating section is heated indirectly by the heat conduction from the heating section and consequently kept cooler than the heating section. The passage structure is positioned in the non-heating section, which is thus kept cooler. Accordingly, the material supplied to the passage structure changes into saturated vapor without being heated extremely rapidly and expanding extremely suddenly, for example, being heated and expanding explosively. Consequently, the saturated vapor from the passage structure flows smoothly into the vapor passages of the heating medium, in which accelerated heating occurs properly.

As stated above, the material can be supplied from a position above the heating medium, while the superheated vapor can be discharged from a position above the heating medium. Accordingly, both the supply and discharge passages can be positioned above or over the heating medium. This enables the superheated vapor generator to be compact, and also enables simple piping and easy maintenance. In addition, the tubular container extends vertically, and the material can be supplied to the non-heating section, which is positioned at a lower portion of the tubular container. Consequently, if the material is water, even in a place where there is neither a boiler nor other equipment for supplying saturated steam, any supply of water enables rapid generation of superheated vapor from the water. This is effective in the simplification of equipment and the reduction of plant investment.

The top of the tubular container may be closed by a closing member fitted removably to the container. The supply and discharge passages may be defined inside a supply pipe and a discharge pipe, respectively, which may be fixed to the closing member. In this case, it is possible to maintain and inspect the inside of the tubular container by merely removing the closing member. Accordingly, the maintenance and inspection are simplified.

An expansion space may be formed over the heating medium so that superheated vapor can expand in the space. In this case, the superheated vapor heated acceleratively in the vapor passages of the heating medium spurts into the expansion space, where expansion pressure relief is performed to form no droplets due to the pressure cohesion caused by cubical expansion when the superheated vapor is generated. High-quality superheated vapor can be discharged from the expansion space through the discharge pipe to be supplied to thermal processing equipment or the like.

The supply passage may extend substantially through the center of the heating medium. In this case, the material flows radially through the passage structure. Consequently, the saturated vapor is heated acceleratively in the whole of the vapor passages of the heating medium, where superheated vapor is generated efficiently.

The bottom of the supply pipe may be adjacent to the top of the non-heating section. This ensures that the material is supplied to the passage structure, so that superheated vapor can be generated steadily through the foregoing process.

The bottom turn of the high frequency induction heating coil may be positioned at substantially the same height as the bottom of the supply pipe. In this case, the bottom of the supply pipe is adjacent to the top of the non-heating section, which is positioned under the bottom turn of the coil. This enables exact supply of liquid to the passage structure.

The heating medium may consist of a plurality of heating elements as unit blocks piled in multilayer form in the tubular container. Each of the heating elements can be shorter than the heating medium, so that their dimensional accuracy can be high. In particular, if the heating elements are sintered blocks, the unit blocks are effective in their accuracy control in consideration of thermal strains etc. Superheated vapor generators of some types may be produced that differ in the capacity for generating superheated vapor. In this case, by piling a different number of heating elements, it is possible to set at a predetermined value the height of the heating medium, which is the total height of the vapor passages, of each of the superheated generators. Accordingly, there is no need to provide an exclusive heating medium according to the capacity of each of the superheated vapor generators, but it is possible to mass-produce heating elements as unit blocks. This is effective in the simplification of quality control and the reduction in cost. Temperature differences beyond a preset range may arise in the heating elements. The temperature differences make differences in expansion and contraction. Because the multilayer heating elements allow relative displacement between them, no crack will be caused in them. If the tubular container contained a single heating medium in place of the multilayer elements, such differences in expansion and contraction might cause cracks in the heating medium.

The tubular container and the heating medium may be cylindrical, and may have substantially vertical axes. In this case, the tubular container and the heating medium are easy to mold, so that the production of them is advantageous. Because the cylindrical container and medium are circular in section, thermal stresses do not concentrate at any points in them. Accordingly, the changes in shape of the cylindrical container and medium that are caused by thermal expansion and contraction are simple and uniform like a change in diameter, so that the durability of the container and medium is improved. By supplying the material to the centers of the cylindrical container and medium, it is possible to distribute liquid or saturated vapor to the whole of the vapor passages of the heating medium. Consequently, superheated vapor can be generated efficiently in the whole of the vapor passages.

The diameter of the cylindrical heating medium may be substantially equal to or larger than the height of the medium. In this case, the length of each of the vapor passages is nearly equal to or smaller than the diameter of the heating medium. Accordingly, when the heating medium is produced by being sintered, the bends in the vapor passages, the distortion of the sectional shape of the passages, etc. can be within tolerance limits.

The vapor passages of the heating medium may be a number of straight passages defined by cross partitions. In this case, the sectional shape of the vapor passages can be square, hexagonal or any other shape that improves their function. In particular, it is possible to increase the specific surface area of the heating medium, thereby increasing the heating area of the medium to improve the heating efficiency of the medium.

The vapor passages of the heating medium may be a number of arcuate spaces defined by a combination of coaxial cylinders having different diameters. The arcuate spaces are simple to form by combining coaxial cylinders of various sizes. The arcuate passages make it possible to reduce the passage resistance exerted to the saturated vapor being heated acceleratively in them. The resistance reduction is effective in increasing the efficiency of superheated vapor generation.

The walls of the coaxial cylinders may be thicker toward the periphery of the heating medium. In this case, the induction field intensity in the superheated vapor generator is so distributed that more magnetic fluxes are canceled toward the axis of the turns of the high frequency induction heating coil, while more magnetic fluxes pass through and near the outer cylindrical surface of the heating medium. It is possible to take advantage of this surface effect on magnetic fluxes by making the cylinder walls thicker toward the periphery of the heating medium. This makes it easy to induce eddy currents in the heating medium, thereby increasing the heating efficiency of the medium.

The radial dimensions of the arcuate spaces may be equal or larger toward the periphery of the heating medium. In this case, by setting the radial dimensions at a predetermined value or larger toward the periphery of the heating medium, it is possible to increase the areas of outer vapor passages of the medium, where the surface effect on magnetic fluxes enable more efficient heating. This enables efficient generation of superheated vapor.

The material for the heating medium may be porous silicon carbide. This makes it possible to form passages for induction heating and as the passage structure out of the single material. The function of the porous passage structure is carried out in part of the porous heating medium, so that the sequentiality between the passage structure and the vapor passages is realized in a simple structure. There is a great difference in the temperature of the heating medium between when the superheated vapor generator is operating and when it is not operating. The great temperature difference greatly changes the amount of thermal expansion and contraction of the heating medium. However, the porous structures absorb the thermal expansion and contraction, thereby preventing cracks from being made by the expansion and contraction in the heating medium. The vapor passages themselves can absorb the thermal expansion and contraction. The absorbing functions of the vapor passages and porous structures are synergistic with each other to prevent cracks more reliably from opening in the heating medium.

The heating medium may carry fine particles of titanium oxide. The carried particles of titanium oxide prevent the oxidation of the heating medium. The catalytic effect of the titanium oxide keeps the surfaces of the heating medium clean under a self-cleaning action, greatly increasing the durability of the medium.

The high frequency induction heating coil may be formed of tubing, through which coolant for cooling the coil flows. In this case, the exciting coil for induction heating also functions as a cooling pipe. By causing the coolant to flow through the tubing, it is possible to prevent the heating coil from deteriorating due to the thermal oxidation caused by the heat generated by the copper loss of the coil, the heat generated by the self-induction of the coil, and the radiant heat and conductive heat from the superheated vapor. This improves the durability of the superheated vapor generator.

DETAILED DESCRIPTION OF THE PREFERRED EMBODIMENTS

Embodiment 1

Figure 1:
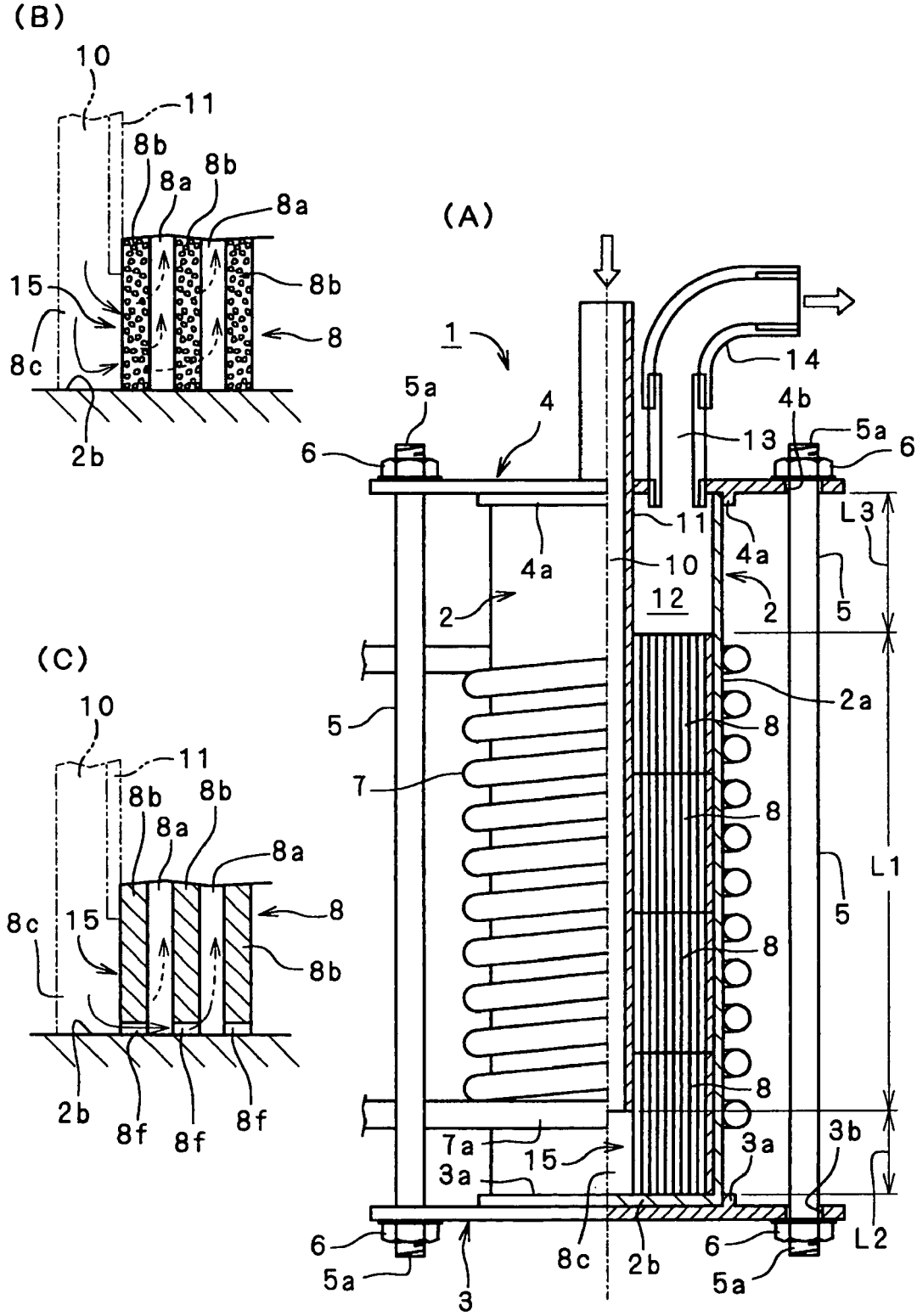
FIG. 1(A) is an elevational view half in section of a superheated vapor generator according to a first embodiment of the present invention.
FIGS. 1(B) and 1(C) are vertical sections of part of different passage structures for this generator.
Figure 2:
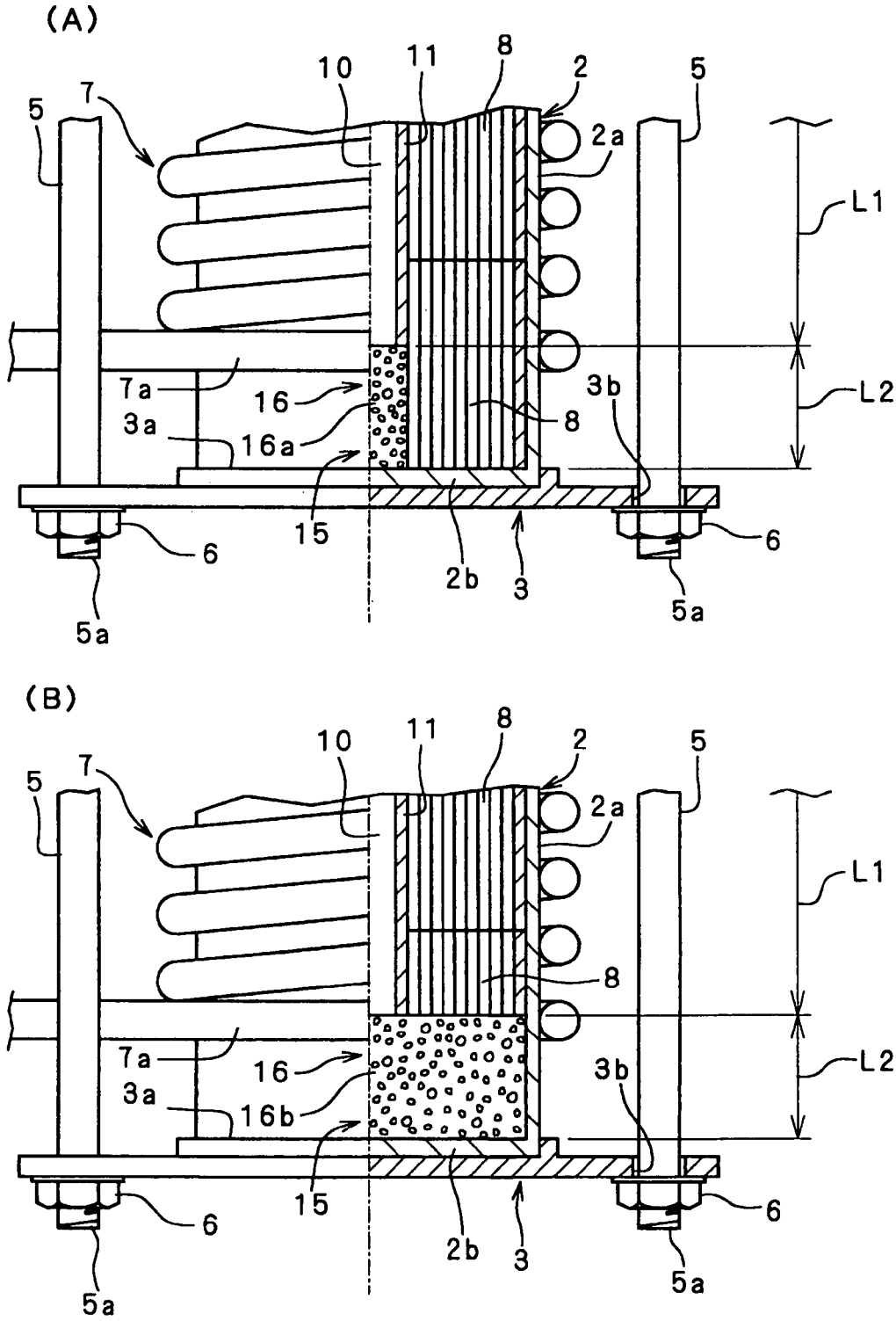
FIGS. 2(A) and 2(B) are elevational views half in section of other superheated vapor generators according to the first embodiment.
Figure 3:
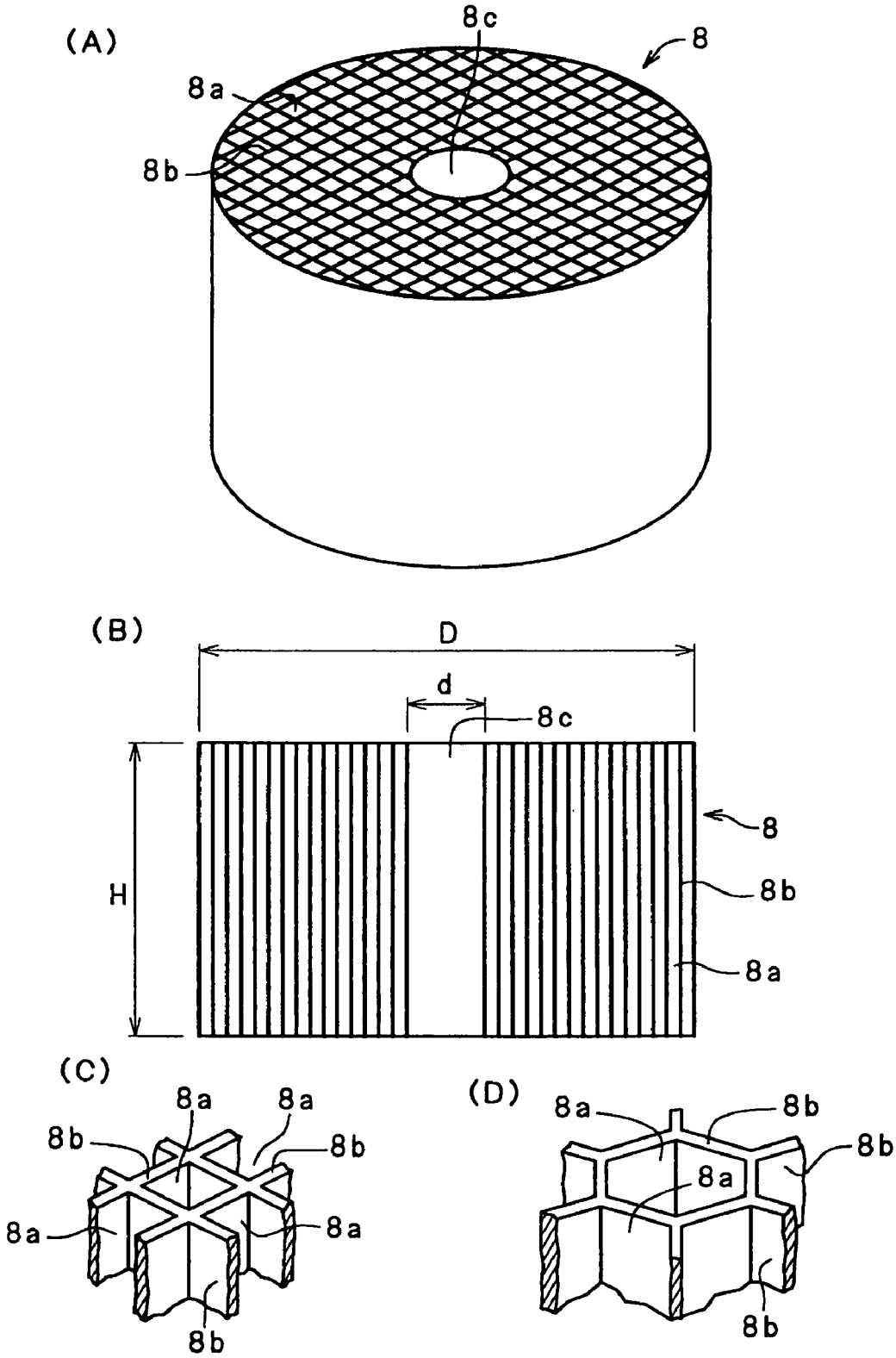
FIG. 3(A) is a perspective view of a heating element for use in the first embodiment.
FIG. 3(B) is an axial section of this heating element.
FIG. 3(C) is a perspective view of part of this heating element.
FIG. 3(D) is a perspective view of part of another heating element for use in this embodiment.

FIGS. 1–3 show superheated vapor generators according to a first embodiment of the present invention.

The superheated vapor generator 1 shown in FIGS. 1(A)–1(C) includes a vertically extending cylindrical container 2. The cylindrical container 2 consists of a cylindrical wall 2*a* and a bottom plate 2*b*, which closes the bottom of the wall. The cylindrical container 2 stands on a lower support plate 3 in the form of a disc, which has a circular support ring 3*a* formed on its upper side. The support ring 3*a* engages with the bottom periphery of the cylindrical container 2 to fix it horizontally. The cylindrical container 2, support plate 3 and support ring 3*a* are coaxial or concentric.

The open top of the cylindrical wall 2*a* of the cylindrical container 2 is closed by an upper support plate 4 in the form of a disc, which has a circular support ring 4*a* formed on its lower side. The support ring 4*a* engages with the top periphery of the cylindrical container 2 to fix it horizontally. The cylindrical container 2, support plate 4 and support ring 4*a* are coaxial or concentric. Alternatively, the top of the cylindrical container 2 might be closed by a ceiling plate, which is similar to the bottom plate 2*b*, and which might engage with the upper support plate 4. As stated above, the closing member for the top of the cylindrical container 2 is the upper support plate 4, but might be the ceiling plate.

Conceivably, the cylindrical container 2 can be held between the upper and lower support plates 4 and 3 in various ways. For example, the cylindrical container 2 might have external threads formed at its top and bottom. The support rings 4*a* and 3*a* might each have an internal thread for engaging with the external thread of the adjacent end of the cylindrical container 2. In this embodiment, the upper support plate 4 has six holes 4*b* formed through it at regular intervals around the support ring 4*a*. Likewise, the lower support plate 3 has six holes 3*b* formed through it at regular intervals around the support ring 3*a*. Vertical connecting rods 5 extend through the holes 3*b* and 4*b*. The connecting rods 5 have external threads 5*a* formed at their both ends for engaging with nuts 6, which can be tightened to hold the cylindrical container 2 between the support plates 4 and 3.

The cylindrical container 2, upper and lower support plates 4 and 3, etc. are made of silicon nitride material as a non-magnetic material to inductively heat cylindrical heating elements 8 as heating media in the form of unit blocks, which are contained in the container 2. The cylindrical container 2 has a height of 300 mm and an outer diameter of 100 mm, and its cylindrical wall 2*a* and bottom plate 2*b* have a thickness of 5 mm. The support plates 4 and 3 have a diameter of 150 mm, and their holes 4*b* and 3*b*, through which the connecting rods 5 extend, have a diameter of 8.5 mm.

With reference to FIGS. 3(A)–3(C), each cylindrical heating element 8 has a number of axial vapor passages 8*a* defined by a number of partitions 8*b*. The partitions 8*b* cross at right angles, so that the vapor passages 8*a* are square or rectangular in section. FIG. 3(D) shows another cylindrical heating element 8 for use in the cylindrical container 2. This heating element 8 has a honeycomb structure, with its partitions 8*b* defining vapor passages 8*a*, which are hexagonal in section.

Heating elements 8 are contained slidably in the cylindrical container 2. The heating elements 8 can be heated inductively by a high frequency induction heating coil 7. Therefore, after the heating elements 8 are formed of silicon carbide into the shape shown in FIGS. 3(A)–3(D), they are sintered. Eddy currents can be induced in silicon carbide. The silicon carbide is porous to form a passage structure 15, which will be described later on. The heating elements 8 are made of porous silicon carbide, but might be made of other magnetic non-metallic or magnetic metallic material.

The porous structures of porous silicon carbide are so made that their porosity ranges between 40% and 45%. The ratio between the independent pores and through pores of the porous structures is adjusted between 2:3 and 3:4. The heating elements 8 shown in FIGS. 1–3 has a porosity of 42%. The vapor passages 8*a* shown in FIGS. 3(C) and 3(D) range between 200 and 400 in number per square inch.

Each heating element 8 has an axial hole 8*c* formed through its center. Four heating elements 8 are piled in the cylindrical container 2, with their axial holes 8*c* forming a straight passage, and with their vapor passages 8*a* communicating axially. The bottom of the lowest heating element 8 is in contact with the bottom plate 2*b* of the cylindrical container 2.

With reference to FIG. 3(B), it is preferable that the outer diameter D of the heating elements 8 should not be smaller than the height H of each heating element 8 ($D \geqq H$). It is also preferable that the outer diameter D and height H be set between 50 and 100 mm. It is further preferable that the diameter d of the axial hole 8*c* be set between 10 and 21 mm. The outer diameter D is 88 mm. The height H is 50 mm. The diameter d is 21 mm.

The cylindrical container 2 includes a heating section L1 and a non-heating section L2, which is positioned under the heating section L1. The heating coil 7 is wound around the heating section L1 to heat the heating elements 8. In order to form the non-heating section L2, the bottom turn 7*a* of the heating coil 7 is spaced over the bottom plate 2*b* of the cylindrical container 2.

The heating coil 7 is a copper pipe, but might be formed of other tubing, through which water flows as coolant for cooling the coil. The copper pipe is formed of DCuT and has a diameter of 12.7 mm. The heating coil 7 has an inner diameter of 100 mm, 10 turns and a height of 230 mm. The coil height nearly equals the height of the heating section L1. The heating coil 7 extends around the vertical container 2.

The voltage output from an AC power supply (not shown) is input to a high frequency generator (not shown). The high frequency generator lowers the input voltage to a value, which may range between 30 and 60 volts, under the shock voltage. The high frequency generator increase the current supplied from the AC power supply. The high frequency generator modulates the increased current into a high frequency current, which may have a frequency between 50 and 200 kHz. The high frequency current is input to the heating coil 7.

In the present invention, as stated already, the material for the generation of superheated vapor is liquid and/or vapor. The liquid includes fine particles of liquid in the form of a mist. The vapor includes gasified liquids and gasified or sublimed solids. In this embodiment, the material is water as a liquid.

The non-heating section L2 of the cylindrical container 2 can be supplied with water as the material for superheated vapor through a supply passage 10, which extends through the upper support plate 4 into the container 2. The supply passage 10 extends along the axis of the heating elements 8. The supply passage 10 is formed inside a straight supply pipe 11. The supply pipe 11 extends through the upper support plate 4 and is fixed to it with a thermoresistance adhesive or the like. The supply pipe 11 further extends through the axial holes 8*c* of the upper three heating elements 8 into the axial hole 8*c* of the bottom heating element 8. The lower end of the supply pipe 11 is positioned near the top of the non-heating section L2. The passage in the supply pipe 11 extends through the axial holes 8*c* to the upper surface of the bottom plate 2*b*. The supply pipe 11 is formed of mullite as a non-magnetic material and has an outer diameter of 20 mm. The distance between the lower end of the supply pipe 11 and the upper support plate 4 is 290 mm.

The water supplied to the non-heating section L2 passes through the passage structure 15 to the vapor passages 8*a* in the heating elements 8. The passage structure 15 may vary in form. The passage structure 15 shown in FIG. 1(B) consists of porous portions of the partitions 8*b* of the heating elements 8. In this case, the water supplied through the supply pipe 11 flows downward onto the bottom plate 2*b* and then passes through the porous portions of the partitions 8*b* into the vapor passages 8*a*.

The space over the top heating element 8 in the cylindrical container 2 is an expansion space 12, where the superheated vapor spurting from the vapor passages 8*a* expands. It is preferable that the height of the non-heating sect ion L2 should range between 5% and 30% of the whole length of the cylindrical container 2. It is most preferable that this section height be 10% of the container length. It is preferable that the height L3 of the expansion space 12 should range between 5% and 50% of the whole length of the cylindrical container 2. It is most preferable that the height L3 be 20% of the container length.

The top of the expansion space 12 communicates with a discharge passage 13, which is formed inside a discharge pipe 14. A lower end portion of the discharge pipe 14 extends through the upper support plate 4 and is fixed to it with a thermoresistance adhesive or the like. As stated above, the supply pipe 11 and discharge pipe 14 extend through the upper support plate 4 and are fixed to it. The pipes 11 and 14 are isolated from each other. It is possible to remove the pipes 11 and 14 together from the cylindrical container 2 by removing the nuts 6 and lifting the upper support plate 4.

The heating elements 8, which are formed of porous silicon carbide, are immersed in a 20% slurry of fine titanium oxide particles having a diameter between 0.5 and 5 μm. Subsequently, the heating elements 8 are dried. The dried elements 8 are burned at 600° C. in a non-oxidation furnace for some hours so as to carry a titanium oxide. This prevents oxidation of the heating elements 8. The catalytic effect of the titanium oxide keeps the surfaces of the heating elements 8 clean under a self-cleaning action. As a result, the durability of the heating elements 8 is greatly increased.

The induction heating by means of the heating coil 7 is effected with the Joule heat resulting from the eddy current losses of the eddy currents induced in the heating elements 8. The eddy current loss P [W/m$^3$] per unit volume can be expressed as the following equation 1.

$$P=(\pi afB)^2/4\rho[W/m^3] \quad \text{(eq. 1)}$$

where:

a represents the radius [m] of the heating elements 8;

B represents the induction flux density [Wb/m$^2$];

ρ represents the specific resistance [Ωm] of the heating elements 8;

f represents the induction frequency [Hz].

The flux density B [Wb/m$^2$] in equation 1 can be expressed as the following equation 2.

$$B=\mu nl \quad \text{(eq. 2)}$$

where:

μ represents the magnetic permeability of the heating elements 8;

n represents the number of turns per meter of the heating coil 7;

l represents the current flowing through the heating coil 7.

The number N of turns of the heating coil 7 that can be wound around the cylindrical container 2 is nl (N=nl), l being the length [m] of the heating elements 8. The number N of turns is not larger than l/d (N<=l/d), d being the pipe diameter [m] of the heating coil 7. Accordingly, it is possible to raise the heating efficiency of the heating elements 8 by substituting for the number n in equation 2 a suitable value larger than 1 but not larger than l/d (1<n<=l/d).

Equations 1 and 2 prove that the heat generating capacity or the output capacity of the superheated vapor generator 1 depends on the frequency f and current l of the high frequency output, the number N of turns of the heating coil 7 and the specific resistance ρ of the heating elements 8. Accordingly, higher frequency f, more current l and suitably low specific resistance ρ are essential for the generation of superheated vapor.

Therefore, by setting the specific resistance ρ of the heating elements 8, which are formed of porous silicon carbide, between 0.1 and 1.0 Ωm, it is possible to raise their heating efficiency, improve their compliance with temperature control and shorten the rise time taken until the generation of superheated vapor. The specific resistance ρ of the heating elements 8 shown in FIGS. 1–3 is 0.62 Ωm.

Description will be provided below of how superheated vapor is generated through the passage structure 15 shown in FIGS. 1(A) and 1(B). First, cooling water is caused to flow at rates of 2.5 kg/m$^2$ and 40 l/min through the heating coil 7. While the cooling water is flowing, water is supplied at a flow rate of 16 g/sec from the supply pipe 11. When some milliseconds pass after a water supply start signal from the supply pipe 11 is fed back, a high frequency current having a frequency of 100 kHz is output to the heating coil 7. The output power is adjusted to 50 kw.

The current supply to the heating coil 7 induces eddy currents in the upper three heating elements 8 and the upper portion of the bottom heating element 8 in the heating section L1, thereby heating this section. Heat is transferred from the heating section L1 to the lower portion of the bottom heating element 8 in the non-heating section L2, so that the non-heating section is indirectly heated. Capillarity causes water to be absorbed into the porous structures of the heating elements 8, in which the absorbed water is heated rapidly and forms saturated steam. When the water changes into the saturated steam, the steam expands suddenly. The saturated steam is forced by its expansion pressure to flow at high speed through the vapor passages 8*a*. The wall surfaces of the vapor passages 8*a* acceleratively heat the saturated steam, so that superheated vapor is generated instantaneously. The superheated vapor spurts into the expansion space 12, where expansion pressure relief is performed to form no water droplets due to the pressure cohesion caused by cubical expansion when the superheated vapor is generated. The superheated vapor is discharged through the discharge pipe 14 to be supplied to thermal processing equipment (not shown) or the like.

It was confirmed that a dry superheated vapor having a temperature of 650° C. was discharged through the discharge pipe 14 when twenty and some seconds passed after the high frequency current was output. It was observed that 62 kg of superheated vapor was generated stably per hour. It was also confirmed that the output of superheated vapor did not fall even after the superheated vapor generator 1 was operated continuously for ten hours per day for three months. After the generator 1 was disassembled, the conditions of the heating elements 8 were inspected. As a result, it was further confirmed that the heating elements 8 were neither deteriorated nor damaged. As stated already, the high frequency current is output after a delay of some milliseconds. It is possible to set this output timing easily by using an ordinary controller that operates in response to various input signals.

The passage structure 15 shown in FIG. 1(C) consists of a number of radial grooves 8*f* formed through the bottoms of the partitions 8*b* of the heating elements 8, which are formed of silicon carbide as a heating material. In this case, the partitions 8*b* are not porous, so that they are not air-permeable. The water supplied through the supply pipe 11 flows through the radial grooves 8*f* into the vapor passages 8*a*. The passage structure 15 would have a double function if the partitions 8*b* with radial grooves 8*f* were porous. The process for generating superheated vapor in this example is the same as that for the example shown in FIG. 1(B). The bottom heating element 8 might be spaced slightly from the bottom plate 2*b* so that slight gaps (not shown) could be formed as a passage structure 15.

In the examples shown in FIGS. 2(A) and 2(B), the passage structures 15 are flow blocks 16 made of non-magnetic material. The flow blocks 16 are made of silicon nitride as a non-magnetic material that is formed into an air-permeable porous structure. Alternatively, the flow blocks 16 might be blocks of silicon nitride having a large number of holes (not shown) formed through them.

In the example shown in FIG. 2(A), a flow block 16*a* is placed in the lower portion of the axial hole 8*c* of the bottom heating element 8 under the supply pipe 11. In this example, as shown in FIG. 1(B), the heating elements 8 are made of porous silicon carbide. The flow block 16*a* is heated indirectly by the heat conduction from the bottom heating element 8. The water supplied through the supply pipe 11 flows through the flow block 16*a* to the vapor passages 8*a*. The process for generating superheated vapor in this example is the same as that for the examples shown in FIGS. 1(A)–1(C).

In the example shown in FIG. 2(B), the heating elements 8 are positioned within the heating section L1, and a flow block 16*b* is positioned in the whole of the non-heating section L2. The partitions 8*b* of the heating elements 8 might not be porous. The flow block 16*b* is heated indirectly by the heat conduction from the bottom heating element 8. The water supplied through the supply pipe 11 flows radially outward through the flow block 16*b*, in which it changes into saturated steam. The saturated steam flows into the vapor passages 8*a*. The process for subsequently generating superheated vapor is the same as that for the examples shown in FIGS. 1(A)–1(C).

The passage structure or structures 15 conduct water to the vapor passages 8*a* and generate saturated steam. Accordingly, the heating elements 8, which are downstream of the passage structure or structures 15, do not necessarily need to be porous. For example, as shown in FIG. 1(C), in the case of the passage structure 15 being the radial grooves 8*f*, the partitions 8*b* may not be porous. Likewise, as shown in FIG. 2(B), in the case of the passage structure 15 being the flow block 16*b* placed in the whole of the non-heating section L2, the heating elements 8 over the flow block 16*b* may not be porous.

The operation and effects of the first embodiment are as follows.

Because the non-heating section L2 is positioned under the heating section L1, which is heated by the high frequency induction heating coil 7, the non-heating section L2 is heated indirectly by the heat conduction from the heating section L1. The passage structure or structures 15, which are positioned in the non-heating section L2, have a preset temperature. The water supplied through the supply passage 10 is distributed through the passage structure or structures 15 into the vapor passages 8*a* of the heating elements 8. While the water is flowing through the passage structure or structures 15, it is heated rapidly to form saturated steam immediately. The saturated steam expands suddenly in the passage structure 15. The expansion pressure forces the saturated steam into the vapor passages 8*a*, in which the saturated steam further keeps expanding, and through which it flows at high speed while acceleratively heated. Through this process, the saturated steam becomes a fully dry superheated vapor. The superheated vapor flows out of the vapor passages 8*a* and through the discharge passage 13 to be supplied to thermal processing equipment (not shown) or the like.

As stated above, water changes into saturated steam in the passage structure 15, and successively the saturated steam is acceleratively heated in the vapor passages 8*a* of the heating elements 8, so that superheated vapor is obtained instantaneously. Thus, the vapor passages 8*a* function in a position immediately downstream of the passage structure 15. This enables efficient generation of superheated vapor, resulting in the reduction of power consumption.

Because the non-heating section L2 is positioned under the heating section L1, which is heated by the high frequency induction heating coil 7, the non-heating section L2 is heated indirectly by the heat conduction from the heating section L1. This keeps the non-heating section L2 cooler than the heating section L1. Because the passage structure 15 is positioned in the non-heating section L2, which is thus kept cooler, the water supplied to this structure 15 changes into saturated steam without being heated extremely rapidly and expanding extremely suddenly, for example, being heated and expanding explosively. Consequently, the saturated steam from the passage structure 15 flows smoothly into the vapor passages 8*a*, in which accelerated heating occurs properly.

Water is supplied from a position above the heating elements 8, while the superheated vapor is discharged from the space over the top heating element 8. Accordingly, the supply passage 10 and the discharge passage 13 can be positioned adjacently to or over the top heating element 8. This enables the superheated vapor generator 1 to be compact, and also enables simple piping and easy maintenance. The water is supplied to the non-heating section L2, which is positioned at a lower portion of the vertically extending cylindrical container 2. Consequently, even in a place where there is neither a boiler nor other equipment for supplying saturated steam, any supply of water enables rapid generation of superheated vapor from the water. This is effective in the simplification of equipment and the reduction of plant investment.

The upper support plate 4, which closes the top of the cylindrical container 2, can be removed from this container 2. The supply pipe 11, which defines the supply passage 10, and the discharge pipe 14, which defines the discharge passage 13, are fixed to the upper support plate 4. This makes it possible to maintain and inspect the inside of the cylindrical container 2 by merely removing the upper support plate 4. Accordingly, the maintenance and inspection are simplified.

The expansion space 12 is positioned over the heating elements 8. The superheated vapor is acceleratively heated in the vapor passages 8*a* of the heating elements 8 and spurts from the passages 8*a* into the expansion space 12, where expansion pressure relief is performed to form no water droplets due to the pressure cohesion caused by cubical expansion when the superheated vapor is generated. A high quality superheated vapor is discharged through the discharge pipe 14 to be supplied to thermal processing equipment (not shown) or the like.

The supply passage 10 extends along the axis of the heating elements 8. Consequently, water flows radially through the passage structure 15, and saturated steam is heated acceleratively over the whole areas in the vapor passages 8*a* of the heating elements 8, so that superheated vapor is generated efficiently.

The bottom of the supply pipe 11 is adjacent to the top of the non-heating section L2. This ensures that water is supplied to the passage structure 15, so that superheated vapor can be generated steadily through the foregoing process.

The bottom turn 7*a* of the high frequency induction heating coil 7 is positioned at nearly the same height as the bottom of the supply pipe 11. Accordingly, the bottom of the supply pipe 11 is adjacent to the top of the non-heating section L2, which is positioned under the bottom turn 7*a* of the coil. This enables exact supply of water to the passage structure 15.

The heating elements 8 are piled in multilayer form in the cylindrical container 2. Accordingly, each of the heating elements 8 as unit blocks can be short, so that their dimensional accuracy can be high. In particular, if the heating elements 8 are sintered blocks, the unit blocks are effective in their accuracy control in consideration of thermal strains etc. Superheated vapor generators 1 of some types may be produced that differ in the capacity for generating superheated vapor. In this case, by piling a different number of heating elements 8, it is possible to set at a predetermined value the total height of the heating elements 8, which is the total height of the vapor passages 8*a*, of each generator 1. Accordingly, there is no need to provide an exclusive heating medium according to the capacity of each generator 1, but it is possible to mass-produce heating elements 8 as unit blocks. This is effective in the simplification of quality control and the reduction in cost. Temperature differences beyond a preset range may arise in the heating elements 8. The temperature differences make differences in expansion and contraction. Because the multilayer elements 8 allow relative displacement between them, no crack will be caused in them. If the cylindrical container 2 contained a single heating medium in place of the multilayer elements 8, such differences in expansion and contraction might cause cracks in the heating medium.

The heating elements 8 are cylindrical. Because the cylindrical container 2 and heating elements 8 are circular in roughly horizontal section, they are easy to mold, so that the production of them is advantageous. Because the cylindrical container 2 and heating elements 8 are circular in section, thermal stresses do not concentrate at any points in them. Accordingly, the changes in shape of the cylindrical container 2 and elements 8 that are caused by thermal expansion and contraction are simple and uniform like a change in diameter, so that the durability of the container 2 and elements 8 is improved. By supplying water to the center of the cylindrical container 2, or of the bottom cylindrical element 8, it is possible to distribute water or saturated steam to the whole of the vapor passages 8*a*. Consequently, superheated vapor can be generated efficiently in the whole of the vapor passages 8*a*.

The diameter of the heating elements 8 is nearly equal to or larger than the height of each of them. In other words, the length of each vapor passage 8*a* is nearly equal to or smaller than the element diameter. Accordingly, when the heating elements 8 are produced by being sintered, the bends in the vapor passages 8*a*, the distortion of the sectional shape of the passages 8*a*, etc. can be within tolerance limits.

The vapor passages 8*a* of the heating elements 8 are straight passages defined by the crossing partitions 8*b*. Accordingly, the sectional shape of the vapor passages 8*a* can be square, hexagonal or any other shape that improves their function. In particular, it is possible to increase the specific surface area of the heating elements 8, thereby increasing their heating area to improve their heating efficiency.

The heating elements 8 are formed of porous silicon carbide. This makes it possible to form passages for induction heating and as the passage structure 15 out of the single material. The function of the porous passage structure 15 is carried out in part of the porous heating elements 8, so that the sequentiality between the passage structure 15 and vapor passages 8*a* is realized in a simple structure. There is a great difference in the temperature of the heating elements 8 between when the superheated vapor generator 1 is operating and when it is not operating. The great temperature difference greatly changes the amount of thermal expansion and contraction of the heating elements 8. However, the porous structures absorb the thermal expansion and contraction, thereby preventing cracks from being made by the expansion and contraction in the heating elements 8. The vapor passages 8*a* themselves can absorb the thermal expansion and contraction. The absorbing functions of the vapor passages 8*a* and porous structures are synergistic with each other to prevent cracks more reliably from opening in the heating elements 8.

The heating elements 8 carry fine particles of titanium oxide to prevent the oxidation of the elements 8. The catalytic effect of the titanium oxide keeps the surfaces of the heating elements 8 clean under a self-cleaning action, greatly increasing the durability of the elements 8.

The high frequency induction heating coil 7 is formed of tubing or pipe material, through which coolant for cooling the coil flows. Accordingly, the exciting coil for induction heating also functions as a cooling pipe. By causing the coolant to flow through the tubing, it is possible to prevent the heating coil 7 from deteriorating due to the thermal oxidation caused by the heat generated by the copper loss of the coil, the heat generated by the self-induction of the coil, and the radiant heat and conductive heat from the superheated vapor. This improves the durability of the superheated vapor generator 1.

Because the heating elements 8 are burned or sintered blocks, particularly their axial bending strains are great. For this reason, as stated already, it is preferable that the outer diameter D of the heating elements 8 as unit blocks should not be smaller than the height H of each heating element 8. This makes it possible to reduce the strains, thereby improving the burning yield. Consequently, the unit cost of the products can be reduced effectively. The reduced strains enable smooth insertion of the heating elements 8 into the cylindrical container 2 and smooth removal of them from the container 2.

By providing unit blocks each having an outer diameter D and a height H that is not greater than the diameter D, and by piling a required number of such unit blocks, it is possible to form heating elements 8 having a desired capacity for outputting superheated vapor. Accordingly, there is no need to provide heating elements 8 of various exclusive sizes for different capacities for outputting superheated vapor. This enables reduction in cost and good control of quality by means of mass production. It is necessary to repair and/or replace only the heating elements 8 as unit blocks, which need repairing. This makes the repairing operation simple and economical.

The heating coil 7 also functioning as a cooling pipe is insulated from the input high voltage by a transformer, which outputs to the coil 7 a voltage under the shock voltage. Accordingly, the safety from electrical leaks and electric shocks enables easy and safe installation.

It is possible to separate from the cylindrical container 2 the supply pipe 11, discharge pipe 14, upper support plate 4, etc. as they are fixed together. It is easy to remove the heating coil 7 around the cylindrical container 2. The heating elements 8 are placed in the cylindrical container 2. Accordingly, the maintenance of the superheated vapor generator 1 involves simplified disassembly of the generator, which includes the steps of removing the upper support plate 4, drawing out the heating elements 8 and removing the heating coil 7. The disassembled generator 1 can be assembled again by the operation in the order reverse to that in which it is disassembled. This makes it possible for even a less experienced engineer to disassemble and maintain a superheated vapor generator 1 with accuracy in the place where it is installed.

In the process of superheated vapor generation, the saturated steam generated due to the porous structure of the heating elements 8 flows through the vapor passages 8*a* while expanding rapidly and heated acceleratively. Consequently, a highly dry superheated vapor can be obtained. The foregoing process of rapidly generating superheated vapor makes it possible to supply an oxygen-free reducing superheated vapor, without oxygen separated from the water.

The cylindrical container 2, the supply pipe 11, through which water is supplied, and the discharge pipe 14 can be fitted to the upper support plate 4 and positioned upright with the plate 4 and container 2 unitized. Consequently, water can be collected in the bottom of the cylindrical container 2. Accordingly, even in a place where there is neither a boiler nor other equipment for supplying saturated steam, any supply of water enables rapid generation of superheated vapor.

In this embodiment, water is supplied to the passage structure 15. Alternatively, in place of water, saturated steam might be supplied through the supply pipe 11. In this case, the saturated steam would flow into the vapor passages 8*a*, in which superheated vapor would be generated by a phenomenon similar to that occurring to water. The superheated vapor is supplied through the discharge pipe 14 to thermal processing equipment (not shown) or the like.

As stated already, the superheated vapor generator 1 is simplified, and there is no need for a boiler or the like for supplying saturated steam to the generator 1. As also stated, the generator 1 is safe from electric shocks etc. Accordingly, the generator 1 can be integrated with or installed near one of various types of processing equipment. This is advantageous in the simplification of the whole installation, the reduction of capital investment, and so on.

Embodiment 2

Figure 4:
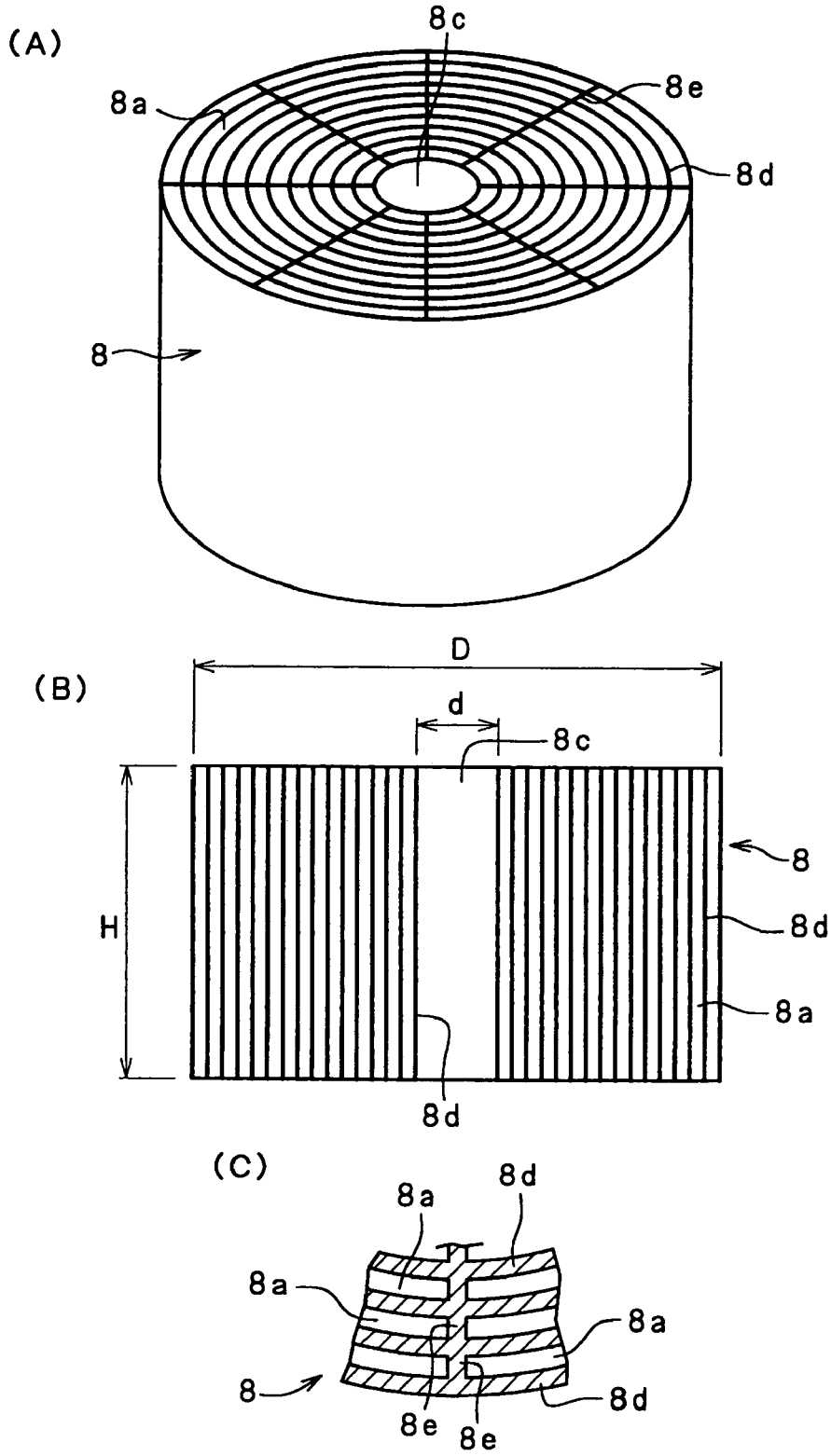
FIG. 4(A) is a perspective view of a heating element of a superheated vapor generator according to a second embodiment of the present invention.
FIG. 4(B) is an axial section of this heating element.
FIG. 4(C) is a radial section of part of this heating element.

FIGS. 4(A)–4(C) show a superheated vapor generator according to a second embodiment of the present invention.

Each heating element 8 of this embodiment includes a number of coaxial cylinders 8*d* having different diameters. The cylinders 8*d* are fixed together by radial partitions 8*e*. Vapor passages 8*a* are formed between the cylinders 8*d* and between the partitions 8*e*. The vapor passages 8*a* are arcuate in radial section and equal in radial size. The heating element 8 in the shape shown in FIGS. 4(A)–4(C) is molded out of a porous silicon carbide material. Otherwise, this embodiment is similar to the first embodiment. Similar parts of the two embodiments are assigned the same reference numerals.

The vapor passages 8*a* are arcuate spaces defined by the coaxial cylinders 8*d* having different diameters. The arcuate spaces are simple to form by combining cylinders 8*d* of different sizes. The arcuate passages make it possible to reduce the passage resistance exerted to the saturated steam being heated acceleratively in them. The resistance reduction is effective in increasing the efficiency of superheated vapor generation. Otherwise, the operation and effects of this embodiment are similar to those of the first embodiment.

Embodiment 3

Figure 5:
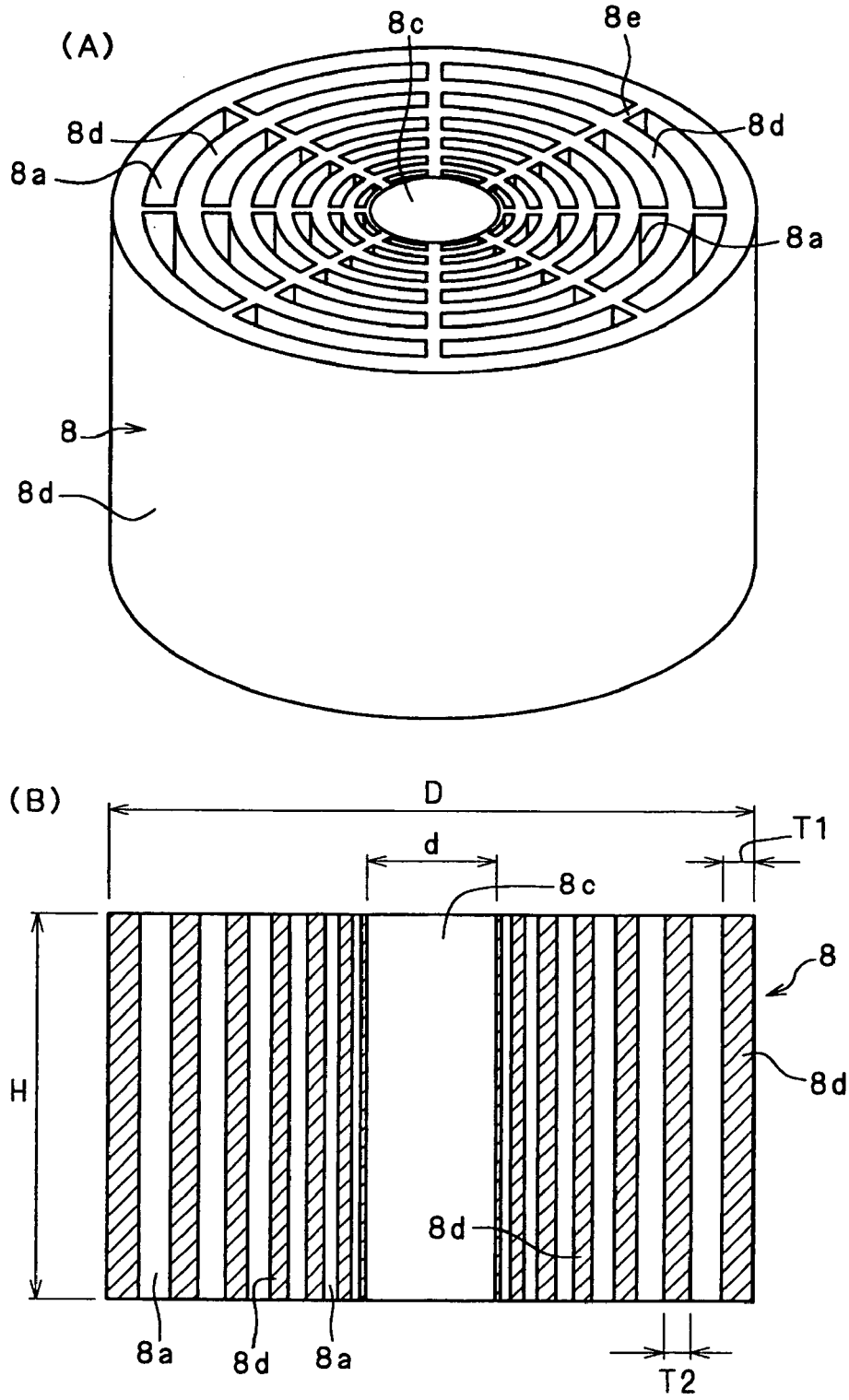
FIG. 5(A) is a perspective view of a heating element of a superheated vapor generator according to a third embodiment of the present invention.

FIGS. 5(A) and 5(B) show a superheated vapor generator according to a third embodiment of the present invention.

Each heating element 8 of this embodiment is similar to that of the first embodiment, but the walls of its coaxial cylinders 8*d* are thicker toward the periphery of the element 8. For example, the walls of the outermost, second outermost and innermost cylinders 8*d* have thicknesses T1, T2 and Tn, respectively, and are thinner toward their axis. Alternatively, the walls of every two or more adjacent cylinders 8*d* might be thinner toward their axis. For example, the walls of the outermost two cylinders 8*d* and second outermost two cylinders 8*d* might have thicknesses T1 and T2, respectively. In this example, the arcuate spaces are larger in radial size toward the periphery of the heating element 8. Otherwise, this embodiment is similar to the foregoing embodiments. Similar parts of the three embodiments are assigned the same reference numerals.

As stated above, the walls of the coaxial cylinders 8*d* are thicker toward the periphery of the heating element 8. Consequently, the induction field intensity in the superheated vapor generator 1 is so distributed that more magnetic fluxes are canceled toward the axis of the turns of the high frequency induction heating coil 7, while more magnetic fluxes pass through and near the outer cylindrical surface of the heating element 8. It is possible to take advantage of this surface effect on magnetic fluxes by making the cylinder walls thicker toward the periphery of the heating element 8. This makes it easy to induce eddy currents in the heating element 8, thereby increasing the heating efficiency of the element 8. Specifically, the induction field intensity distribution in the generator 1 is as follows.

$$H=I/2a\ [A/m] \qquad \text{(eq. 3)}$$

where:
H represents the magnetic field [A/m];
a represents the radius [m] of the coil turns;
I represents the coil current [A].

Accordingly, more magnetic fluxes are canceled toward the axis of the coil turns, while more magnetic fluxes pass through and near the outer cylindrical surface of the heating element 8. It is possible to take advantage of this skin effect on magnetic fluxes by making the walls of the coaxial cylinders 8*d* thicker toward the periphery of the heating element 8. This makes it easy to induce eddy currents, thereby increasing the heating efficiency of the heating elements 8. Otherwise, the operation and effects of this embodiment are similar to those of the foregoing embodiments.

The radial dimensions of the arcuate spaces of the heating element 8 are equal or larger toward the periphery of the element 8. Accordingly, by setting these radial dimensions at a predetermined value or larger toward the element periphery, it is possible to increase the areas of outer vapor passages 8*a*, where the surface effect on magnetic fluxes enable more efficient heating. This enables efficient generation of superheated vapor.

Embodiment 4

Figure 6:
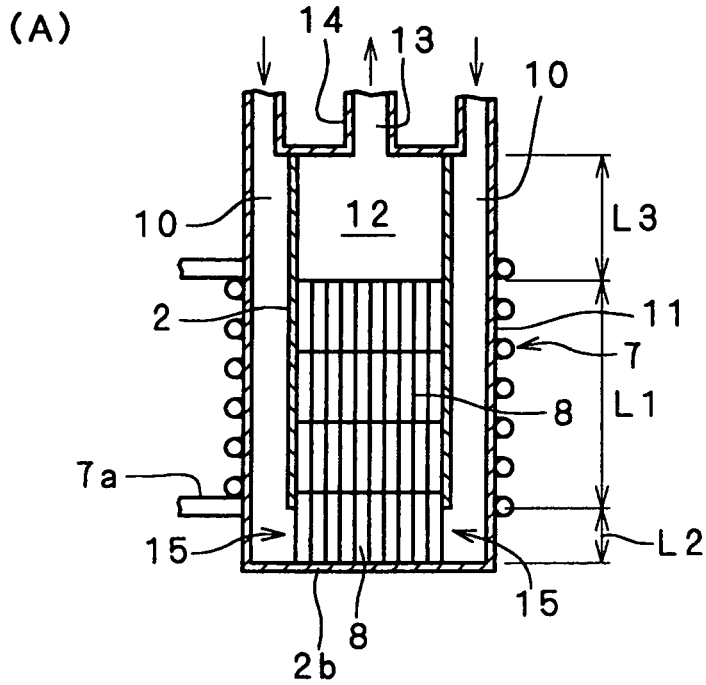
FIGS. 6(A) and 6(B) are axial sections of superheated vapor generators according to a fourth embodiment of the present invention.
Figure 6:
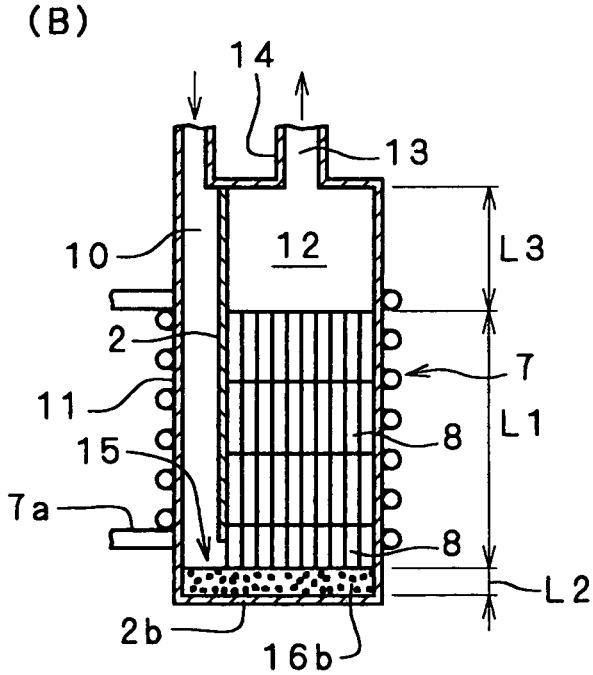

FIGS. 6(A) and 6(B) show superheated vapor generators according to a fourth embodiment of the present invention.

In each of the embodiments shown in FIG. 1–5, the water supply passage 10 extends along the axis of the heating elements 8. The superheated vapor generator shown in FIG. 6(A) has a cylindrical supply passage 10 formed around heating elements 8. The superheated vapor generator shown in FIG. 6(B) has a supply passage 10 formed radially outside and eccentrically from heating elements 8. This superheated vapor generator includes a flow block 16*b* positioned under the bottom heating element 8. Otherwise, this embodiment is similar to the foregoing embodiments. Similar parts of all the embodiments are assigned the same reference numerals. The operation and effects as well of this embodiment are similar to those of the foregoing embodiments.

INDUSTRIAL APPLICABILITY

In the superheated vapor generator according to the present invention, material such as liquid and/or vapor flows into the cylindrical container. Saturated steam is generated in the passage structure within the cylindrical container. Subsequently, the saturated steam is heated acceleratively in the vapor passages within the cylindrical container to form superheated vapor. The material is supplied downward to the superheated vapor generator, while the superheated vapor is discharged upward from the generator. This makes it possible to obtain fully dry high-quality superheated vapor. This also enables the superheated vapor generator itself to be compact. This further makes it easy for users to disassemble and maintain the superheated vapor generator. The superheated vapor generator, which has various improvements as stated already, will be highly evaluated or appreciated by customers and can be expected to come into wide use.

What is claimed is:

1. A superheated vapor generator comprising:

a tubular container extending substantially vertically and having closed top and bottom ends;

a high frequency induction heating coil wound around the tubular container;

a heating medium placed in the tubular container;

the heating medium being formed of material that can be heated by electromagnetic induction;

the heating medium having a number of vapor passages extending therethrough substantially longitudinally of the tubular container;

the tubular container having a heating section formed therein where the heating coil heats the heating medium;

the tubular container further having a non-heating section formed therein under the heating section;

a supply passage through which material for superheated vapor can be supplied from a position above the heating medium to the non-heating section;

a passage structure provided in the non-heating section so that the material supplied through the supply passage can flow through the structure into the vapor passages of the heating medium;

a discharge passage formed above the heating medium so that superheated vapor can be discharged through the discharge passage;

a closing member fitted removably to the tubular container to close the top end of the container;

a supply pipe defining the supply passage thereinside and fixed to the closing member; and a discharge pipe defining the discharge passage therein and fixed to the closing member.

2. The superheated vapor generator of claim 1 having an expansion space formed over the heating medium so that superheated vapor can expand in the space.

3. The superheated vapor generator of claim 1 wherein the supply passage extends substantially through the center of the heating medium.

4. The superheated vapor generator of claim 1 wherein the bottom of the supply pipe is adjacent to the top of the non-heating section.

5. The superheated vapor generator of claim 1 wherein the bottom turn of the high frequency induction heating coil is positioned at substantially the same height as the bottom of the supply pipe.

6. The superheated vapor generator of claim 1 wherein the heating medium consists of a plurality of heating elements piled in multilayer form in the tubular container.

7. The superheated vapor generator of claim 1 wherein the tubular container and the heating medium are cylindrical and have substantially vertical axes.

8. The superheated vapor generator of claim 7 wherein the diameter of the heating medium is substantially equal to or larger than the height of the medium.

9. The superheated vapor generator of claim 1 wherein the vapor passages of the heating medium are a number of straight passages defined by cross partitions.

10. The superheated vapor generator of claim 1 wherein the vapor passages of the heating medium are a number of arcuate spaces defined by a combination of coaxial cylinders having different diameters.

11. The superheated vapor generator of claim 10 wherein the walls of the coaxial cylinders are thicker toward the periphery of the heating medium.

12. The superheated vapor generator of claim 10 wherein the radial dimensions of the arcuate spaces are equal or larger toward the periphery of the heating medium.

13. The superheated vapor generator of claim 1 wherein the material for the heating medium is porous silicon carbide.

14. The superheated vapor generator of claim 1 wherein the heating medium carries fine particles of titanium oxide.

15. The superheated vapor generator of claim 1 wherein the high frequency induction heating coil is made of tubing through which coolant for cooling the coil can flow.

16. The superheated vapor generator of claim 1 wherein the closing member comprises a first support plate.

17. The superheated vapor generator of claim 16 wherein the first support plate is substantially flat.

18. The superheated vapor generator of claim 16 wherein the support plate is maintained on the tubular container by a plurality of connecting rods having nuts which can be loosened to separate the first support plate from the tubular container.

19. The superheated vapor generator of claim 16 wherein the first support plate is substantially flat and is separable together with the supply and discharge pipes from the tubular container.

20. The superheated vapor generator of claim 16 wherein the tubular container is maintained captive between the first support plate and a separate, second support plate.

* * * * *

UNITED STATES PATENT AND TRADEMARK OFFICE

CERTIFICATE OF CORRECTION

PATENT NO. : 7,145,114 B2
APPLICATION NO. : 11/022388
DATED : December 5, 2006
INVENTOR(S) : Toshio Wakamatsu et al.

It is certified that error appears in the above-identified patent and that said Letters Patent is hereby corrected as shown below:

On The Title Page: Item (75)

The spelling of the first named inventor should be as follows:

Toshio Wakamatsu

Signed and Sealed this

Tenth Day of April, 2007

JON W. DUDAS
*Director of the United States Patent and Trademark Office*